US010535488B2

(12) United States Patent
Durand

(10) Patent No.: US 10,535,488 B2
(45) Date of Patent: Jan. 14, 2020

(54) SLOW WAVEGUIDE FOR TRAVELLING WAVE TUBE

(71) Applicant: THALES, Courbevoie (FR)

(72) Inventor: Alain Durand, La Garenne Colombes (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/043,440

(22) Filed: Jul. 24, 2018

(65) Prior Publication Data

US 2019/0035592 A1 Jan. 31, 2019

(30) Foreign Application Priority Data

Jul. 27, 2017 (FR) ..... 17 00801

(51) Int. Cl.

| | |
|---|---|
| ***H01J 23/24*** | (2006.01) |
| ***H01P 11/00*** | (2006.01) |
| ***H01J 23/16*** | (2006.01) |
| ***H01P 3/123*** | (2006.01) |

(52) U.S. Cl.

CPC ..... *H01J 23/24* (2013.01); *H01J 23/165* (2013.01); *H01P 3/123* (2013.01); *H01P 11/002* (2013.01)

(58) Field of Classification Search

CPC ..... H01J 23/24; H01J 23/165; H01J 25/00; H01J 25/02; H01J 25/34; H01P 3/123; H01P 11/002

See application file for complete search history.

(56) References Cited

U.S. PATENT DOCUMENTS

| | | | | |
|---|---|---|---|---|
| 4,129,803 | A * | 12/1978 | Friz | H01J 23/24 29/600 |
| 4,409,519 | A * | 10/1983 | Karp | H01J 23/24 315/3.5 |
| 4,586,009 | A * | 4/1986 | James | H01J 23/24 29/600 |
| 8,549,740 | B1 * | 10/2013 | Hwu | H01J 23/24 29/600 |
| 9,041,289 | B2 * | 5/2015 | Baik | B23K 15/0026 29/600 |
| 2003/0030390 | A1 * | 2/2003 | Theiss | H01J 23/22 315/500 |
| 2010/0327743 | A1 * | 12/2010 | Durand | H01J 23/005 315/3.5 |
| 2012/0081003 | A1 * | 4/2012 | Baik | B23K 15/0026 315/3.5 |
| 2013/0051724 | A1 * | 2/2013 | Baik | G02B 6/12 385/14 |
| 2016/0293376 | A1 * | 10/2016 | Nakano | H01J 23/24 |

FOREIGN PATENT DOCUMENTS

| | | |
|---|---|---|
| FR | 2 510 814 A1 | 2/1983 |
| KR | 2017-0025508 A | 3/2017 |

* cited by examiner

*Primary Examiner* — Thai Pham

(74) *Attorney, Agent, or Firm* — Baker & Hostetler LLP

(57) ABSTRACT

A slow waveguide for travelling wave tube includes a central plate comprising a beam slip hole, rectilinear in the same direction as the longitudinal axis of the central plate, a bottom plate and a top plate closing the waveguide, respectively arranged on and under the central plate, and a slit folded in the form of a snake having its folds in the direction of the thickness of the guide.

8 Claims, 10 Drawing Sheets

SLOW WAVEGUIDE FOR TRAVELLING WAVE TUBE

CROSS-REFERENCE TO RELATED APPLICATIONS

This application claims priority to foreign French patent application No. FR 1700801 filed on Jul. 27, 2017, the disclosure of which is incorporated by reference in its entirety.

FIELD OF THE INVENTION

The present invention relates to a delay line or slow waveguide for travelling wave tube, with the acronym TWT.

BACKGROUND

In most microwave tubes the interaction between the wave and the beam is broken down into two steps:

- a first step: obtaining a grouping of the electrons in bundles, that is to say producing a modulation of density of the current of the beam at the rate of the microwave signal; and
- a second step: placing the duly obtained bundles of electrons in a phase in which they are slowed down by the field in order to give up their energy to the wave.

In the case of TWTs, the grouping of the electrons in bundles is obtained by placing the beam in the field of a travelling wave whose phase velocity is equal to the velocity of the electrons. In a moving reference frame, the electrons see the field of a standing wave. The electrons are slowed over one alternation and accelerated over the next. A bundle of electrons is formed around the phase for which there is a transition from an accelerator field to a decelerator field.

A conventional waveguide, of rectangular or cylindrical section, is not suitable for the interaction because the phase velocity of the wave which is propagated in this guide is greater than the velocity of light while the velocity of the electrons is less than the velocity of light. Furthermore, an electrical field parallel to the displacement of the electrons is essential although the fundamental mode of the rectilinear guides of rectangular or cylindrical section is at right angles to the axis of the guide. To obtain a phase velocity less than that of light, a special guide is required that is called slow waveguide or delay line. More often than not the delay line is a periodic line obtained by translating a basic cell. Such is the case of the helix, of the coupled cavity line, of the interdigital line, etc.

In the field of TWTs operating at millimetric wavelengths, a delay line called folded guide is often used. This line is obtained by periodically positioning rectangular waveguide sections at right angles to the axis of the beam, and by alternately linking the straight guide sections by flat E bends at 180°. The cross-sectional view of the folded guide has the form of a snake. The beam slip hole is situated in the middle of the straight rectangular guide section. The electrical field in the guide is at right angles to the long side of the guide, and therefore parallel to the displacement of the electrons, which makes it possible to modulate the beam. The electron is therefore displaced in the slip hole, emerges in the straight guide section where it is subjected to the action of the electrical field (interaction space), passes back into the slip hole and emerges in the next interaction space. The electron therefore sees the successive interaction spaces with a period equal to the pitch of the line whereas the geometrical period of the line is equal to twice the pitch. The length of the folded waveguide (straight part and bends) is determined for the phase-shift of the wave in the guide to correspond to the phase variation linked to the displacement of the electrons from one interaction space to the next.

This folded guide line represents an analogy with the line with cavities coupled by alternate irises if the straight rectangular guide section is likened to a cavity where the wave-beam interaction occurs, and the flat E bends are likened to the coupling irises (see FIG. 11*a*). The particular feature of this line is that the same dimension is imposed for the width of the cavity and the width of the iris (the long side of the rectangular guide), which means that the bandwidth cannot be adjusted.

It is known practice to produce delay lines as illustrated in FIGS. 1 to 5, which schematically represent the central plate production which is then placed between a bottom plate and a top plate making it possible to close the waveguide.

FIG. 1 represents a central plate 1, in which a slip hole 2 for the electron beam is drilled in the lengthwise direction of the central plate 1. The central plate 1 has a rectangular parallelepipedal form whose faces are parallel to the axis of the slip hole 2 and symmetrical in relation to the axis of the slip hole 2.

As represented in FIG. 2, an emerging slit 3, in the form of a snake, is produced in the central plate 1, or in other words over all the thickness of the plate 1, over most of the length of the central plate 1, having its folds or meanders in the widthwise direction of the central plate 1.

The machined central plate 1 is equivalent to two interleaved combs 4, 5, as illustrated in FIG. 3, linked at the ends (different hatchings). It is also an alternative technology for producing this line (by using two combs and two rules for positioning the combs). The pitch of the slit 3 is the distance between successive portions of the slit 3 (or successive holes) along the longitudinal axis. The geometrical period of the slit 3 is equal to twice the pitch.

The removal of material which accompanies the machining of the slit 3 of the central plate 1 releases the stresses which can be reflected by deformations of the central plate 1. Thus, a longitudinal displacement or a transverse displacement of one comb relative to the other can in particular occur, as illustrated respectively in FIGS. 4 and 5.

The longitudinal displacement of one comb relative to the other, as illustrated in FIG. 4, modifies the width of the slit 3 which is no longer regular. In its displacement along the axis of the beam, in the slip hole 2, an electron sees a short interaction space followed by a long interaction space (portions of the slit 3). The period of the folded waveguide, or in other words the period of the slit 3 seen by the electron beam, is no longer the pitch of the slit 3 but approximately doubled. There is therefore a biperiodicity which can be reflected by a strong mismatch and risks of oscillations.

The transverse displacement of one comb relative to the other, as illustrated in FIG. 5, is reflected by an offset of the slip tunnel from one tooth of one comb to the next tooth of the other comb. There is then biperiodicity and risk of oscillation. Furthermore, the alignment defect reduces the useful section for transporting the beam, because it induces offset portions of the slip hole 2, and is reflected by a greater interception of the electron beam, which limits the average power of the travelling wave tube using such a waveguide.

Furthermore, a combination of the problems induced by a longitudinal slip and by a transverse slip of the two combs relative to one another is also possible.

FIGS. 6 and 7 schematically represent a waveguide, respectively in an exploded view and in a cross-sectional view along the longitudinal axis of the central plate 1.

In the example represented, the waveguide comprises a central plate 1 provided with a beam slip hole 2, rectilinear in the same direction as the longitudinal axis of the central plate 1, and comprises a slit 3, machined through the central plate 1. A bottom plate 6 and a top plate 7 close the waveguide, the slit 3 having its folds in the widthwise direction of the central plate 1. In this nonlimiting example, the folds or meanders of the folded waveguide or slit 3 are in the form of notches, or rectangular.

SUMMARY OF THE INVENTION

One aim of the invention is to overcome the abovementioned problems.

There is proposed, according to one aspect of the invention, a slow waveguide for travelling wave tube comprising:

- a central plate comprising a beam slip hole, rectilinear in the same direction as the longitudinal axis of the central plate,
- a bottom plate and a top plate closing the waveguide, respectively arranged on and under the central plate, and
- a slit folded in the form of a snake having its folds in the direction of the thickness of the guide, i.e. in the direction of the thickness of the central plate, or at 90° to the widthwise direction of the prior art.

A slow waveguide for travelling wave tube or folded waveguide whose folds or irises are in the direction of the thickness of the central plate, i.e. in the direction of the thickness of the guide, makes it possible to not have the problems of longitudinal and/or transverse displacement.

According to one embodiment, the folds of the slow waveguide for travelling wave tube are produced by irises present alternately in the successive blades on one face then the other of the delay line plate, and/or present alternately in the bottom and top plates facing the slits.

The irises or folds can be produced in the central plate, in the top and bottom plates, or partly in each.

In one embodiment, a fold is in the form of a notch, or in other words of rectangular form.

Such a form allows for easy machining.

As a variant, a fold is of rounded or circular form.

According to one embodiment, the central plate is made of copper, of copper alloy or of molybdenum.

The delay line plate can be made of copper, of copper alloy (tungsten-copper W—Cu, molybdenum-copper Mo—Cu), of molybdenum, or of any other material having a good thermal conductivity, and not magnetisable, in order to not disturb the beam focussing magnetic field.

The use of molybdenum or of a refractory material makes it possible to have a high melting point, which is advantageous in the case of bombardment by the electron beam.

In one embodiment, the bottom and top plates are made of copper, of copper alloy or of molybdenum.

Producing the bottom and top plates in the same material as the central plate makes it possible to avoid the problems of differential expansion during the brazing.

According to another aspect of the invention, also proposed is a method for fabricating a slow waveguide for travelling wave tube comprising the steps of:

- drilling a beam slip hole, rectilinear in the same direction as the longitudinal axis of a central plate;
- drilling a series of parallel open slits in the central plate, the slits being at right angles to the slip hole, forming a series of blades between two parallel consecutive slits; and
- producing irises forming the folds of a folded slit, by alternately machining the successive blades on one face then the other of the central plate, or by alternately machining the bottom and top plates facing the parallel slits.

In one embodiment, the method further comprises a step of closing the guide by the bottom plate and the top plate, fixed respectively onto the bottom face and onto the top face of the central plate.

BRIEF DESCRIPTION OF THE DRAWINGS

The invention will be better understood on studying a few embodiments described in the way of nonlimiting examples and illustrated by the attached drawings in which.

In all the figures, the elements that have identical references are similar.

DETAILED DESCRIPTION

In the present description, the embodiments described are nonlimiting, and the features and functions well known to the person skilled in the art are not described in detail.

Figure 1:
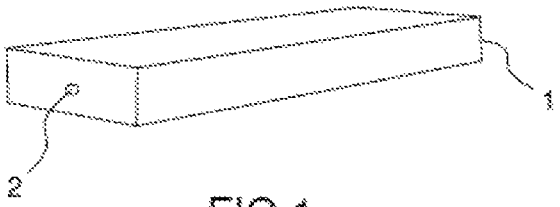
FIG.1 PRIOR ART
FIGS. 1 to 7, 11*a* and 11*b* schematically illustrate examples of production of folded waveguides, according to the prior art.
Figure 2:
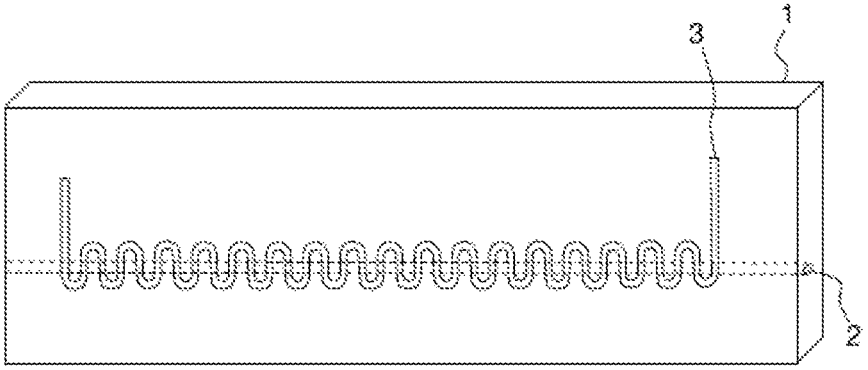
FIG.2 PRIOR ART
Figure 3:
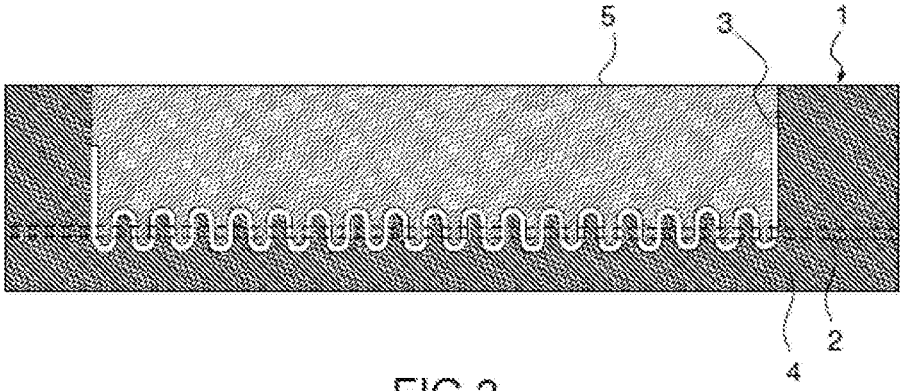
FIG.3 PRIOR ART
Figure 4:
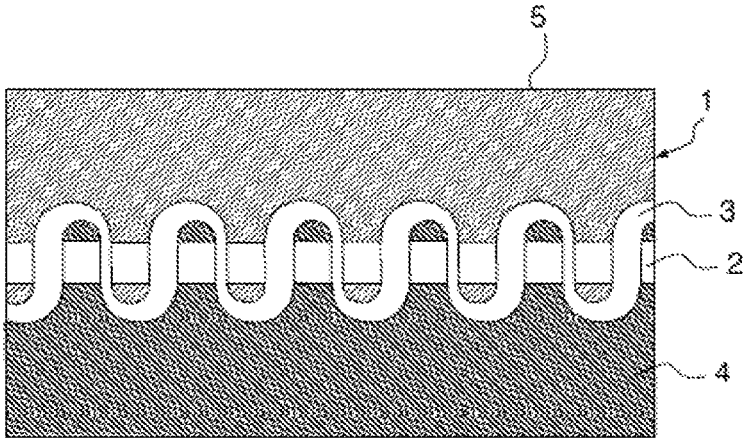
FIG.4 PRIOR ART
Figure 5:
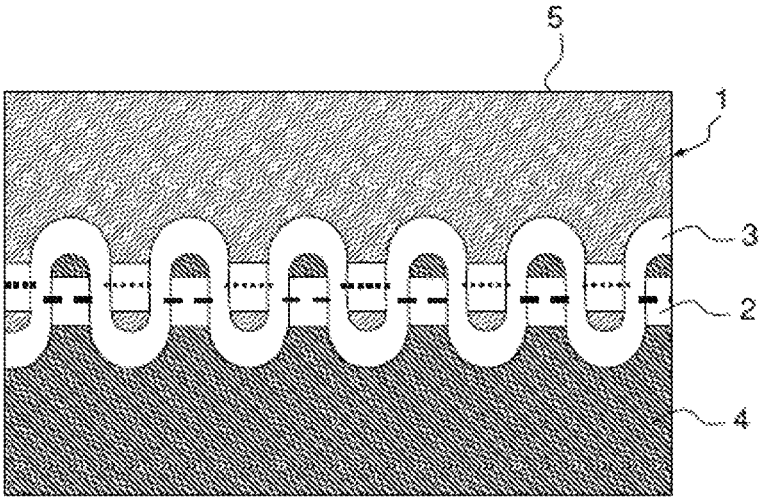
FIG.5 PRIOR ART
Figure 6:
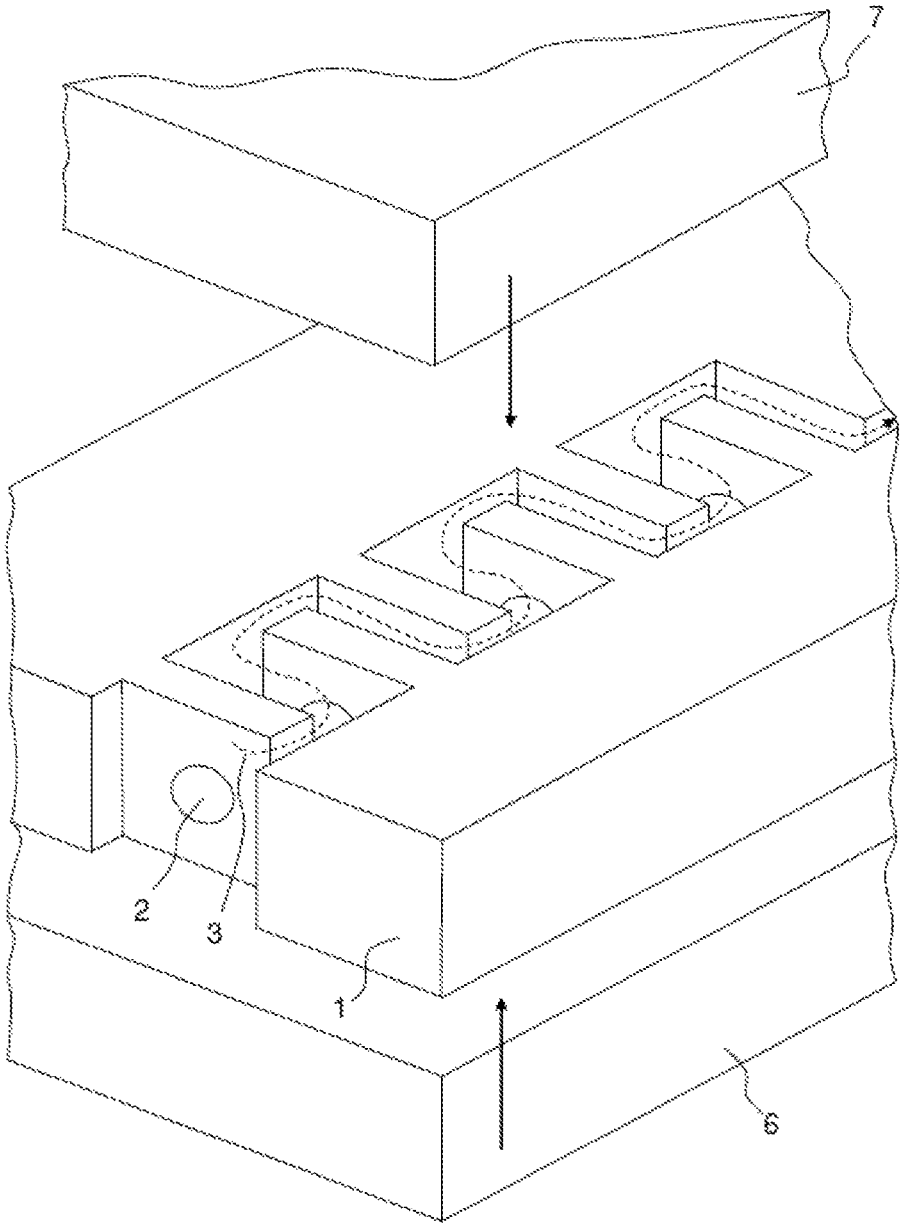
FIG.6 PRIOR ART
Figure 7:
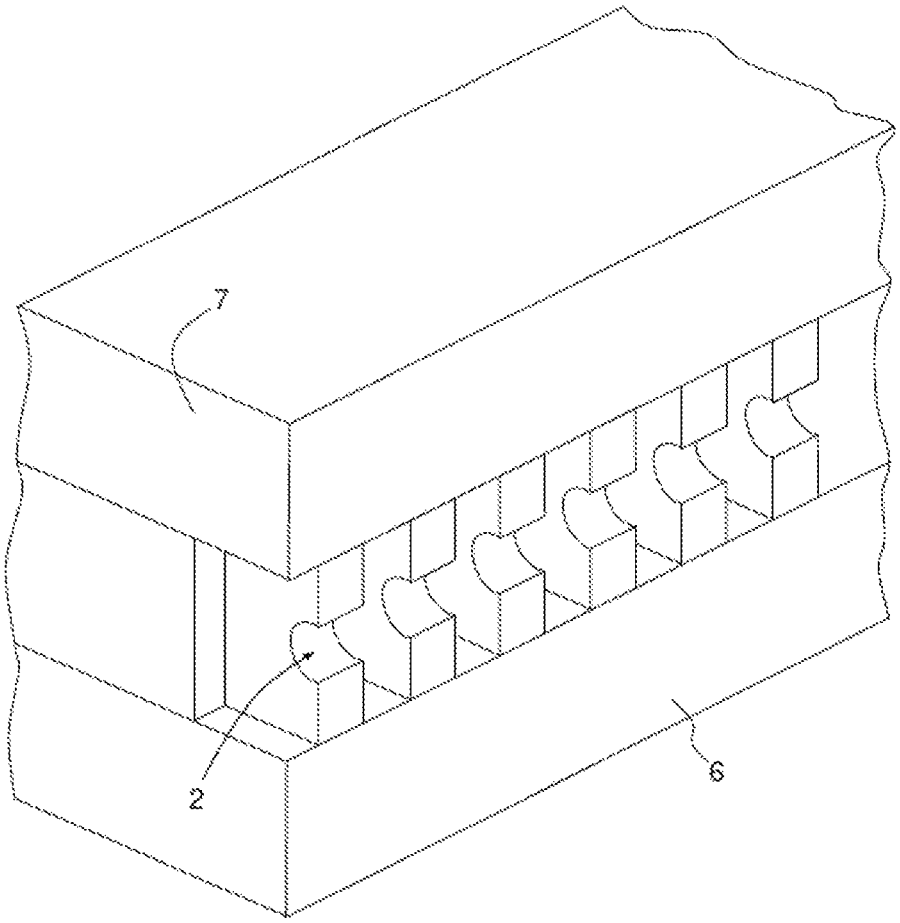
FIG.7 PRIOR ART
Figure 8:
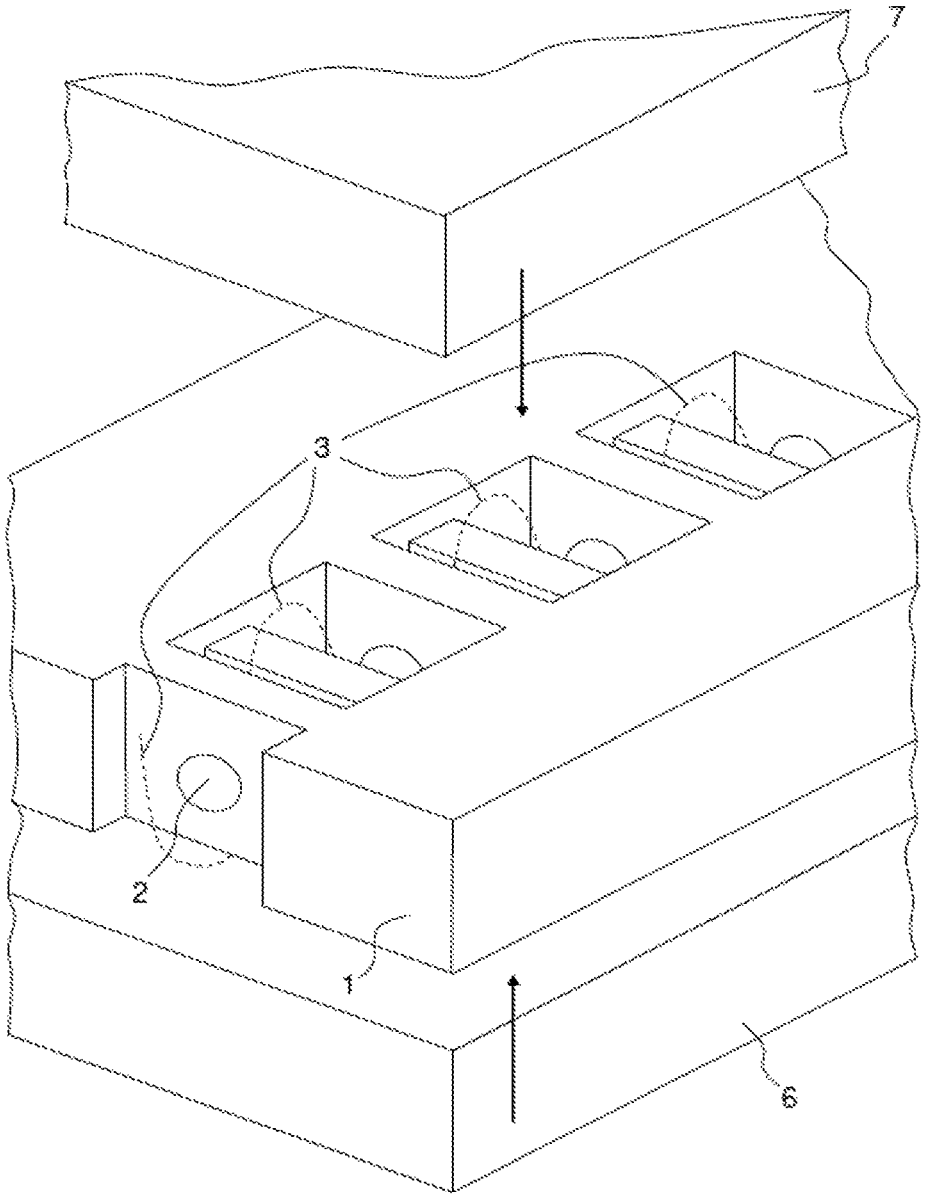
FIGS. 8 to 10, 11*c*, 12*a* to 12*c* schematically illustrate various embodiments of a slow waveguide, according to various aspects of the invention.
Figure 9:
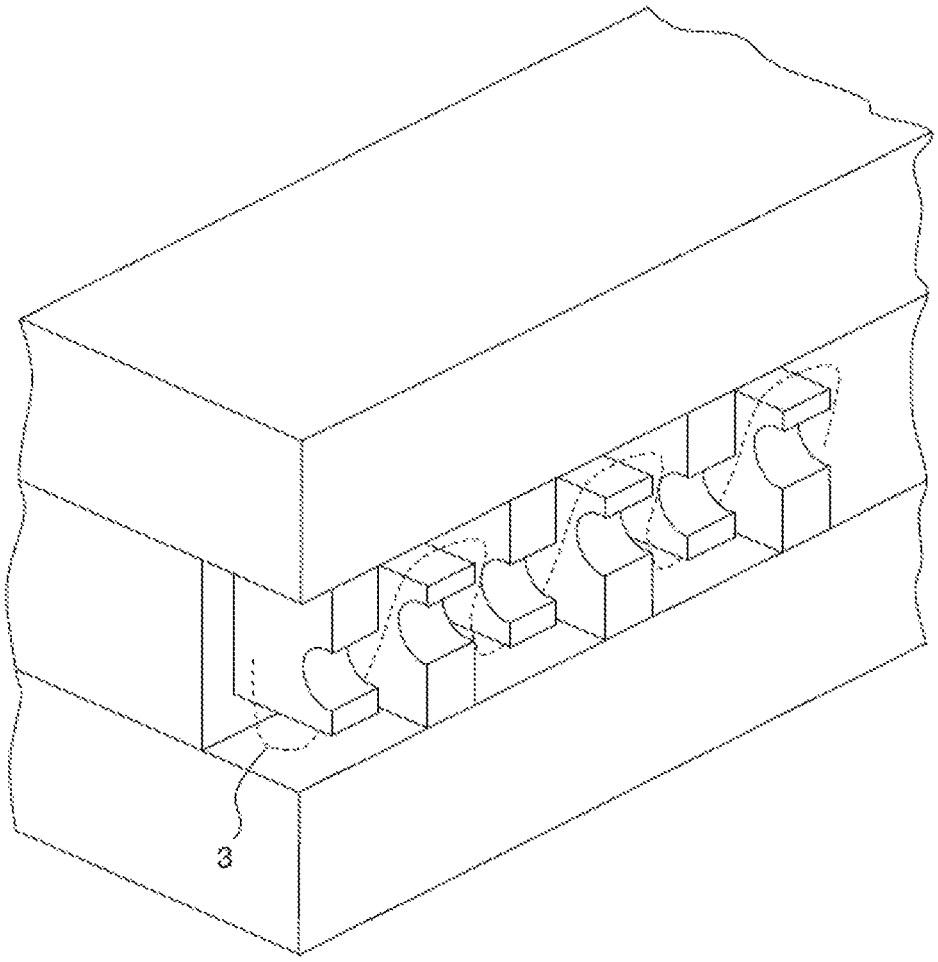

FIGS. 8 and 9 represent a folded waveguide whose folds are in the form of notches.

A beam slip hole 2 is drilled that is rectilinear, in the same direction as the longitudinal axis of a central plate 1, and a series of parallel open slits are drilled in the central plate 1, the slits being at right angles to the slip hole 2, forming a series of blades between two consecutive slits, and irises are produced forming the folds of a folded slit 3, by alternately machining the successive blades on one face then the other of the delay line plate 1, or by alternately machining bottom 6 and top 7 plates facing the slits, or partly both.

Thus, a waveguide is obtained comprising a central plate 1 comprising a beam slip hole 2, rectilinear in the same direction as the longitudinal axis of the central plate 1, and comprising a folded slit 3, the central plate 1 being arranged between a bottom plate 6 and a top plate 7 closing the waveguide, the folded slit 3 having its folds in the direction of the thickness of the central plate 1. In this nonlimiting example, the folds of the folded waveguide 3 are produced by irises machined alternately in successive blades of the central plate 1 on one face then the other of the central plate 1, or machined alternately in the bottom 6 and top 7 plates facing the slits separating the blades, or alternately partially in a blade of the central plate 1 and one of the bottom 6 or top 7 plates.

Figure 10:
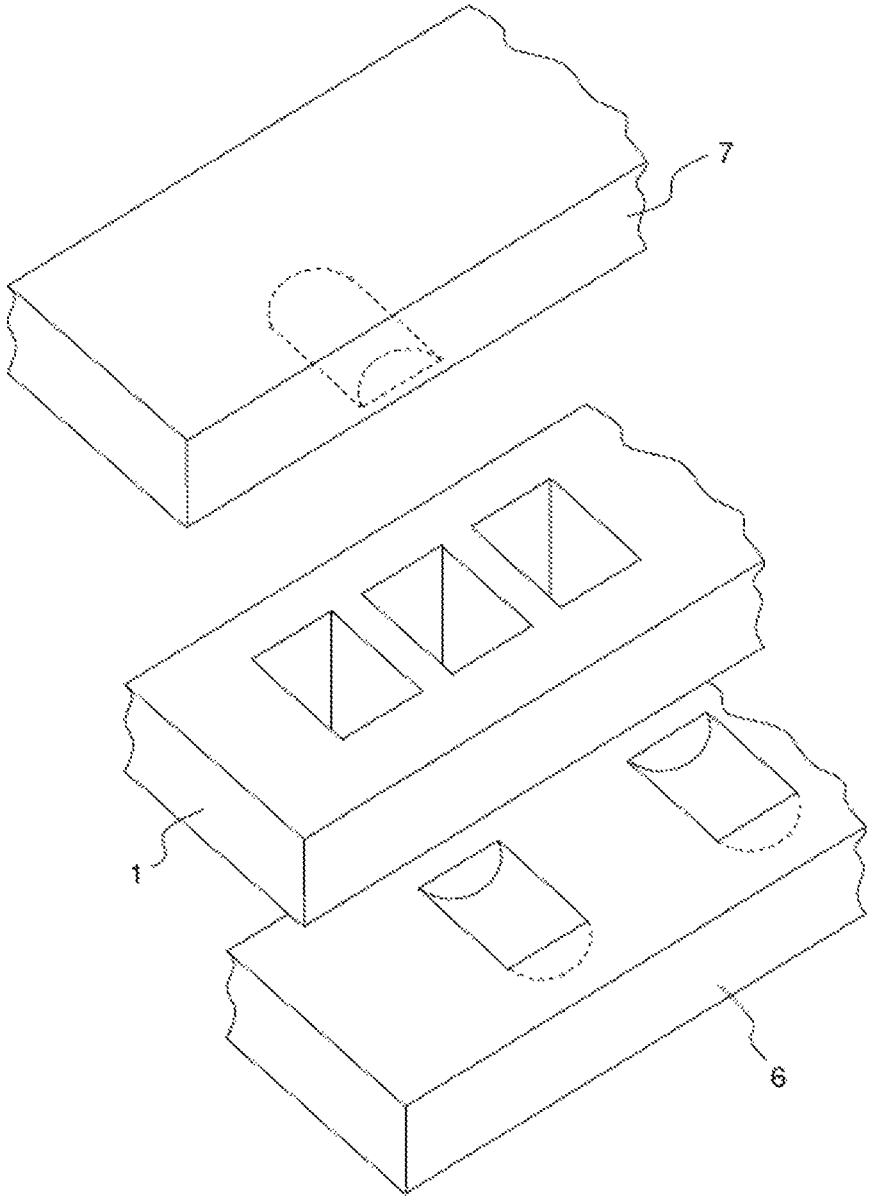

This example is nonlimiting, because any variant folded slit 3 whose folds or meanders are in the direction of the thickness of the central plate 1 is suitable, for example with irises forming the folds that can be machined wholly or partly in the bottom 6 and top 7 plates. One such example of folds of rounded or circular form is illustrated in FIG. 10, produced alternately in the bottom 6 and top 7 plates.

Figure 11A:
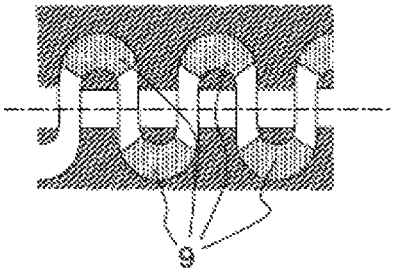
FIG.11a PRIOR ART
Figure 11B:
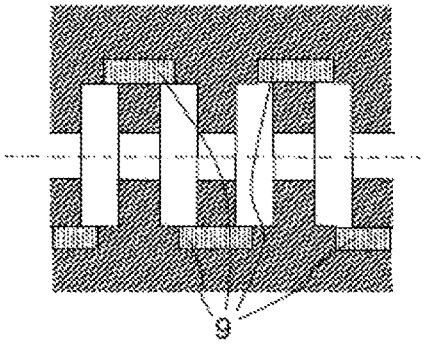
FIG.11b PRIOR ART

FIGS. 11*a* and 11*b* concern lines according to the prior art, with irises in the form of flat E bends at 180° for FIG. 11*a* and with straight irises of a length less than the pitch for FIG. 11*b*. These figures represent a cross-sectional view of the line of the central plate 1, along a plane parallel to the top and bottom faces of the central plate 1, passing through the longitudinal axis of the beam slip hole 2. The irises 9 forming the folds are represented shaded by small dots.

Figure 11C:
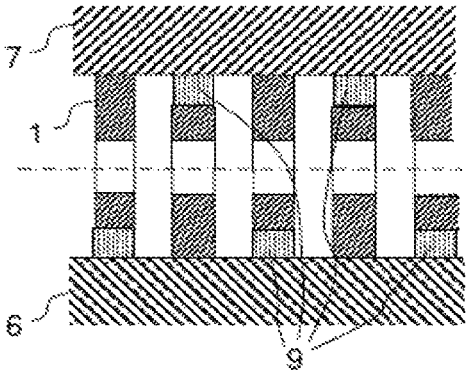

FIG. 11*c* represents a cross-sectional view of the plates 1, 6 and 7 assembled, along a plane at right angles to the top and bottom faces of the central plate 1, passing through the longitudinal axis of the beam slip hole 2. The irises 9 forming the folds are represented shaded by small dots.

Figure 12A:
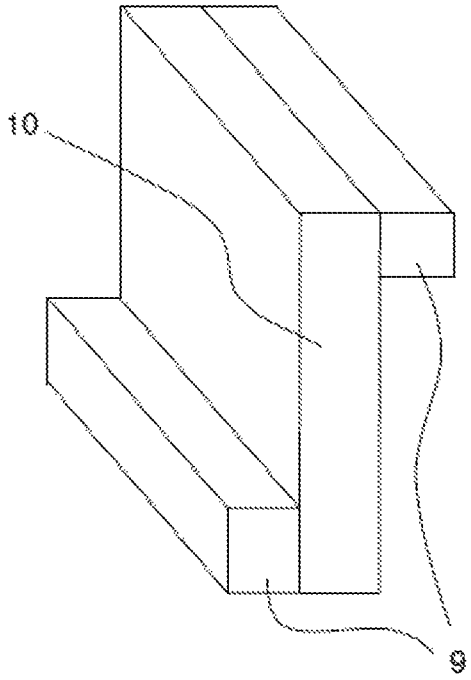
Figure 12B:
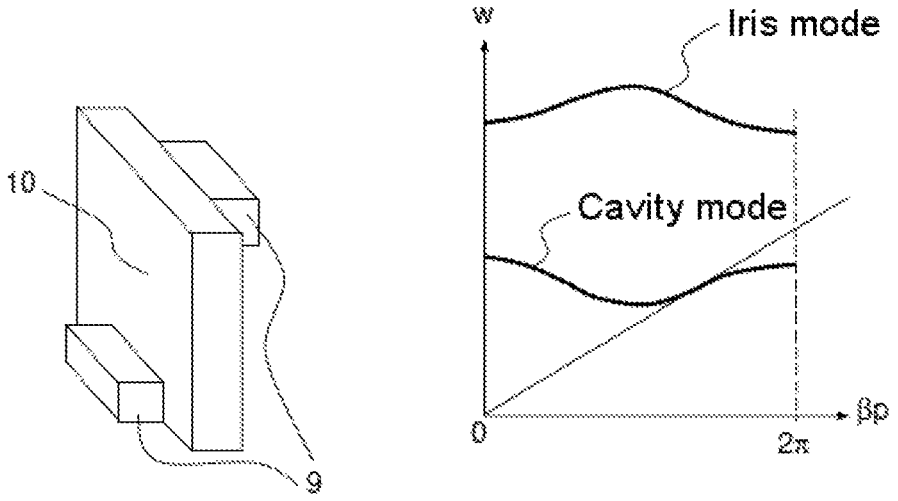
Figure 12C:
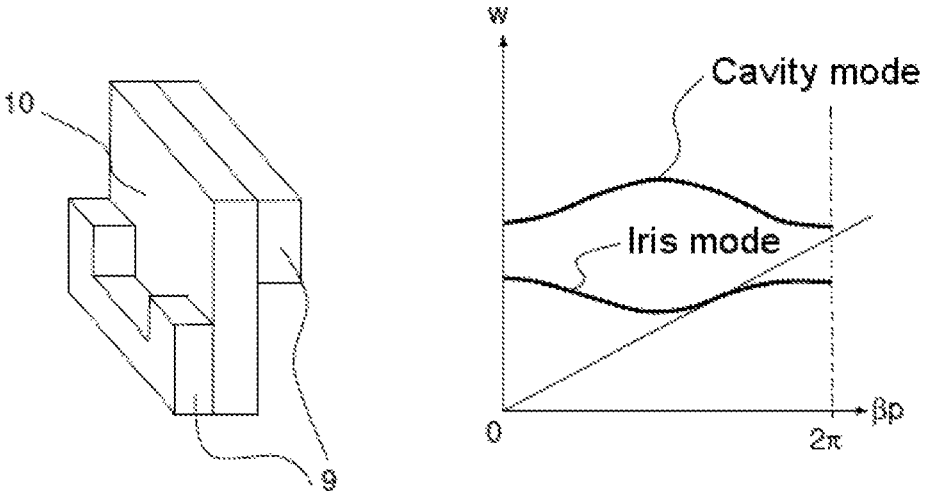

FIGS. 12*a*, 12*b* and 12*c* represent various embodiments of a waveguide according to one aspect of the invention, with folds or irises of the folded slit 3 in the form of notches, i.e. with bends at 90°. In these cases, it can be considered that the folds of the folded slit 3 are produced by means of parallel emerging slits in the central plate 1, the slits 10 being at right angles to the slip hole 2, forming a series of blades between two consecutive slits. In FIGS. 12*b* and 12*c*, the graphs on the right represent the scatter diagram of the periodic line, also called Brillouin diagram, which shows, on the x axis, the phase shift of the wave for a pitch p (therefore from one interaction space to the next) and, on the y axis, the pulsing $\omega=2\pi F$, F representing the frequency in Hz and $\beta$ the propagation constant of the wave in rad/m.

In this case, it is possible to consider the folded slit 3 as a series of parallelepipedal cavities 10 coupled by irises 9 that are also parallelepipedal.

In the case of FIG. 12*a*, the feature of the folded slit 3 is that the width of the cavity is equal to the width of the iris, i.e. the thickness of the central plate 1, when the folded slit 3 is entirely machined in the central plate 1. As a variant, it is possible to choose an iris width that is different from the width of the cavity in order to choose the mode on which the interaction takes place and to adjust the bandwidth of the tube.

It is possible, as a variant, as illustrated in FIG. 12*b*, to take an iris width smaller than that of the cavity, which means a resonance frequency of the iris greater than that of the cavity: in this case, the lowest frequency mode (that with which the beam interacts) is the cavity mode. Reducing the width of the iris reduces the bandwidth of the mode (and that of the corresponding travelling wave tube), but increases the margin in relation to the oscillation at frequency $2\pi$.

It is not possible to machine an iris wider than the rest of the folded slit 3, but it is possible, as illustrated in FIG. 12*c*, to machine an iris by giving it the form of a ridge guide to obtain a resonance frequency of the iris lower than that of the cavity. The lowest mode is then the iris mode.

The invention claimed is:

1. A slow waveguide for travelling wave tube comprising:

a central plate comprising a beam slip hole, rectilinear in the same direction as the longitudinal axis of the central plate, a bottom plate and a top plate closing the waveguide, respectively arranged on and under the central plate, and a slit folded in the form of a snake having a plurality of folds folded vertically up and down in the direction of the thickness of the waveguide.

2. The waveguide according to claim 1, wherein the plurality of folds of the slit are produced by irises that are present alternately in at least one of:

successive blades of the central plate on one face then the other of the central plate, and the bottom and top plates facing the slit separating the blades.

3. The waveguide according to claim 1, wherein the plurality of folds are notches.

4. The waveguide according to claim 1, wherein the plurality of folds are rounded or of circular form.

5. The waveguide according to claim 1, wherein the central plate is made of copper, of copper alloy, or of molybdenum.

6. The waveguide according to claim 1, wherein the bottom and top plates are made of copper, of copper alloy, or of molybdenum.

7. A method for fabricating a slow waveguide for travelling wave tube comprising steps of:

drilling a beam slip hole, rectilinear in the same direction as the longitudinal axis of a central plate;

drilling a series of parallel open slits in the central plate, the slits being at right angles to the beam slip hole, forming a series of blades between two parallel consecutive slits; and producing irises forming a plurality of folds of a folded slit folded vertically up and down in the direction of the thickness of the waveguide, by at least one of:

alternately machining the successive blades on one face then the other of the central plate, and alternately machining bottom and top plates facing the parallel slits.

8. The method according to claim 7, further comprising a step of closing the waveguide by the bottom plate and the top plate, fixed respectively onto the bottom face and onto the top face of the central plate.

* * * * *